United States Patent [19]

Foster et al.

[11] Patent Number: 4,598,843

[45] Date of Patent: Jul. 8, 1986

[54] TAKE-UP PISTON SHIPPING LOCK FOR VISCOUS PRODUCT DISPENSERS

[75] Inventors: Donald D. Foster, Lee's Summit; Robert N. Hills, Raytown; David G. Moore, Lee's Summit; Phil L. Nelson, Kansas City, all of Mo.

[73] Assignee: Realex Corporation, Kansas City, Mo.

[21] Appl. No.: 659,677

[22] Filed: Oct. 11, 1984

[51] Int. Cl.[4] ..... B67D 5/32; G01F 11/00

[52] U.S. Cl. ..... 222/153; 222/260; 222/387

[58] Field of Search ..... 222/153, 386, 387, 389, 222/391, 340, 341, 326, 327, 207, 209, 256, 257, 259, 260

[56] References Cited

U.S. PATENT DOCUMENTS

| | | | |
|---|---|---|---|
| 1,902,822 | 3/1933 | Becker | 222/256 X |
| 2,124,077 | 7/1938 | Ostendorf | 222/256 |
| 3,059,819 | 10/1962 | Sundholm | 222/256 X |
| 3,752,367 | 8/1973 | Sundholm | 222/386 X |
| 3,847,304 | 11/1974 | Cohen | 222/326 X |
| 4,511,068 | 4/1985 | Bossina | 222/387 X |

FOREIGN PATENT DOCUMENTS

| | | | |
|---|---|---|---|
| 465157 | 12/1968 | Switzerland | 222/386 |

*Primary Examiner*—Joseph J. Rolla
*Assistant Examiner*—Kevin P. Shaver
*Attorney, Agent, or Firm*—Schmidt, Johnson, Hovey & Williams

[57] ABSTRACT

The atmospheric pressure-operated take-up piston of the dispenser is provided with releasable locking structure which retains the piston prior to first intentional actuation of the dispenser against jarring movements tending to pressurize the contents and promote leakage during shipment and storage. Once the piston has been intentionally unlocked from its starting position at one end of the dispenser, it is free to travel under the influence of atmospheric pressure to take up space left vacant by discharged product. Several different forms of structure means for the take-up piston are disclosed.

1 Claim, 10 Drawing Figures

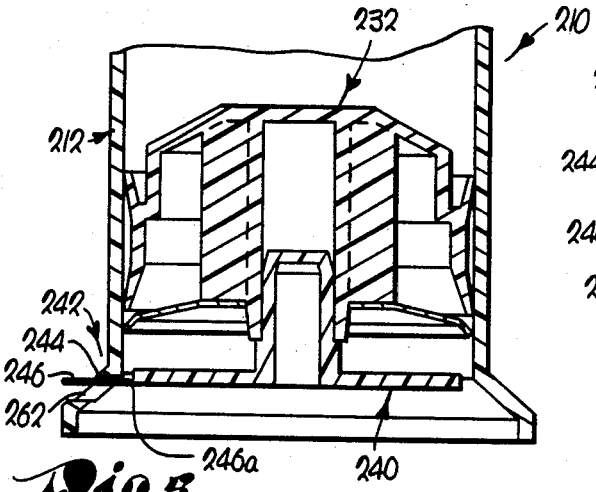
Fig. 5
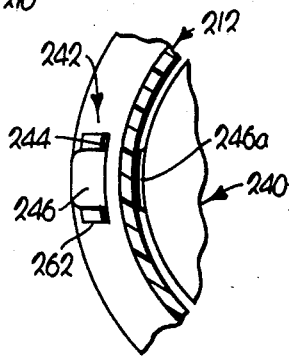
Fig. 6
Fig. 8
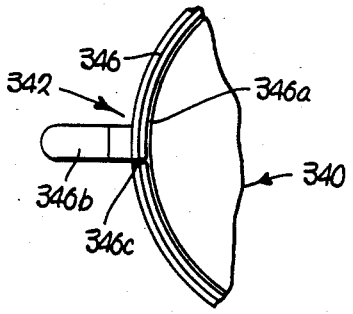
Fig. 7
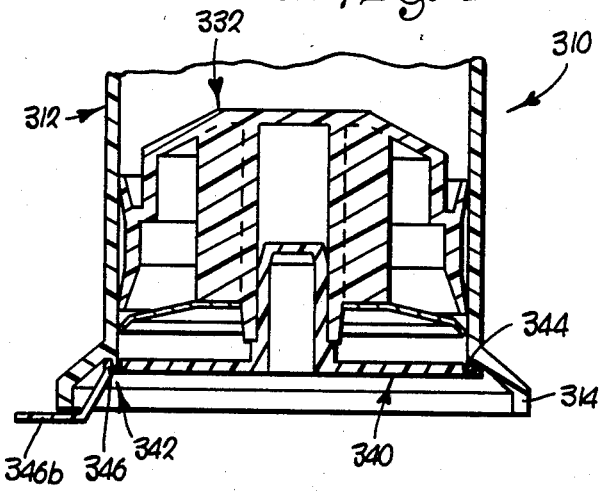
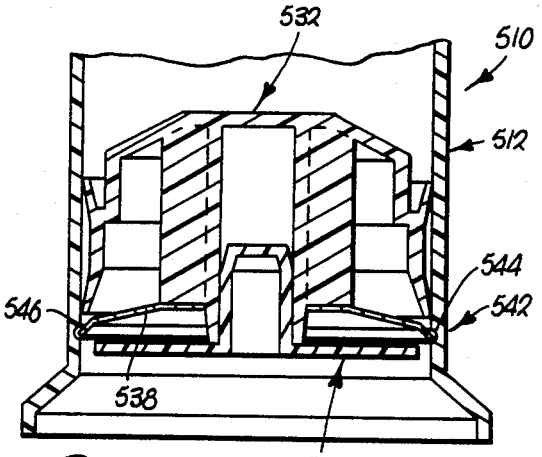
Fig. 10
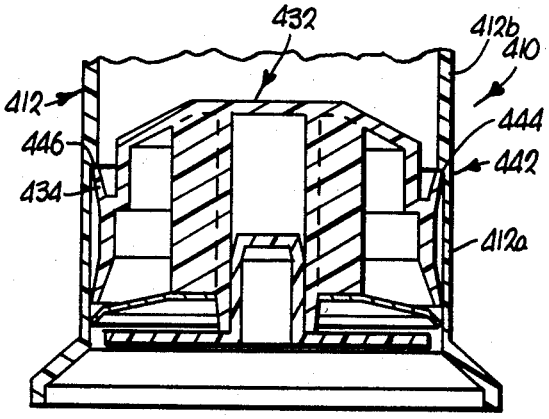
Fig. 9

TAKE-UP PISTON SHIPPING LOCK FOR VISCOUS PRODUCT DISPENSERS

TECHNICAL FIELD

This invention relates to the field of manually-operated pumping dispensers having particular utility for viscous products such as toothpaste and the like.

BACKGROUND

Prior co-pending applications Ser. No. 06/565,540, filed Dec. 27, 1983, and Ser. No. 06/589,640 filed Mar. 14, 1984, both assigned to the assignee herein, disclose a viscous product dispenser utilizing a free-floating take-up piston which automatically responds to the discharge of a volume of product from the dispenser by moving under the influence of atmospheric pressure to "take up" the space in the chamber left vacant by the discharged product. It has been found that in isolated circumstances during shipment or other handling of the dispenser, a sharp blow to the dispenser may result in the take-up piston inching forwardly in the product chamber by a small increment, notwithstanding the fact that the actuating lever has not been depressed. Because the take-up piston is provided with one-way retaining structure which prevents it from moving in a reverse direction, once the takeup piston has been jarred forwardly, it applies an additional loading pressure to the contents and encourages at least a minimal amount of seepage from the discharge spout of the dispenser. This can occur to a certain extent even though the actuating lever as disclosed in such prior applications is provided with a shutoff valve flap integral therewith that covers the outlet of the spout during periods of nonuse.

Another prior co-pending application Ser. No. 06/653,297, filed Sept. 24, 1984, also assigned to the assignee herein discloses and claims a removable shipping seal in the form of a tape or the like which covers the discharge spout of the dispenser and guards against seepage in that manner. Prior to first actuation of the device, the tape is simply pulled from the spout and discarded.

SUMMARY OF THE PRESENT INVENTION

An important object of the present invention is to provide an alternative to the aforementioned sealing tape concepts in the form of locking means associated with the take-up piston itself and which is operable when locked to prevent the takeup piston from moving toward the opposite end of the dispenser in a way which would tend to pressurize the contents. At the time of first actuation of the dispenser, the locking means is released, permitting the piston to perform in the usual way.

BRIEF DESCRIPTION OF THE DRAWINGS

FIG. 5 is a fragmentary vertical cross-sectional view of the dispenser illustrating a third form of take-up piston locking means constructed in accordance with the principles of the present invention;

FIG. 6 is a fragmentary transverse cross-sectional view thereof illustrating details of construction;

FIG. 7 is a fragmentary vertical cross-sectional view of the dispenser illustrating a fourth embodiment of take-up piston locking means constructed in accordance with the principles of the present invention;

FIG. 8 is a fragmentary top plan view of the cover plate and integral, tear-away locking strip removed from the dispenser in order to reveal details of construction;

FIG. 9 is a fragmentary vertical cross-sectional view of the dispenser illustrating a fifth form of locking means wherein the piston must override an impediment built into the interior wall surface of the dispenser body; and FIG. 10 is a fragmentary vertical crosssectional view of the dispenser showing a sixth embodiment of the locking means in accordance with the present invention wherein the anti-retrograde structure of the floating piston is maintained in a disabled condition prior to initial, intential movement thereof.

DETAILED DESCRIPTION

Figure 1:
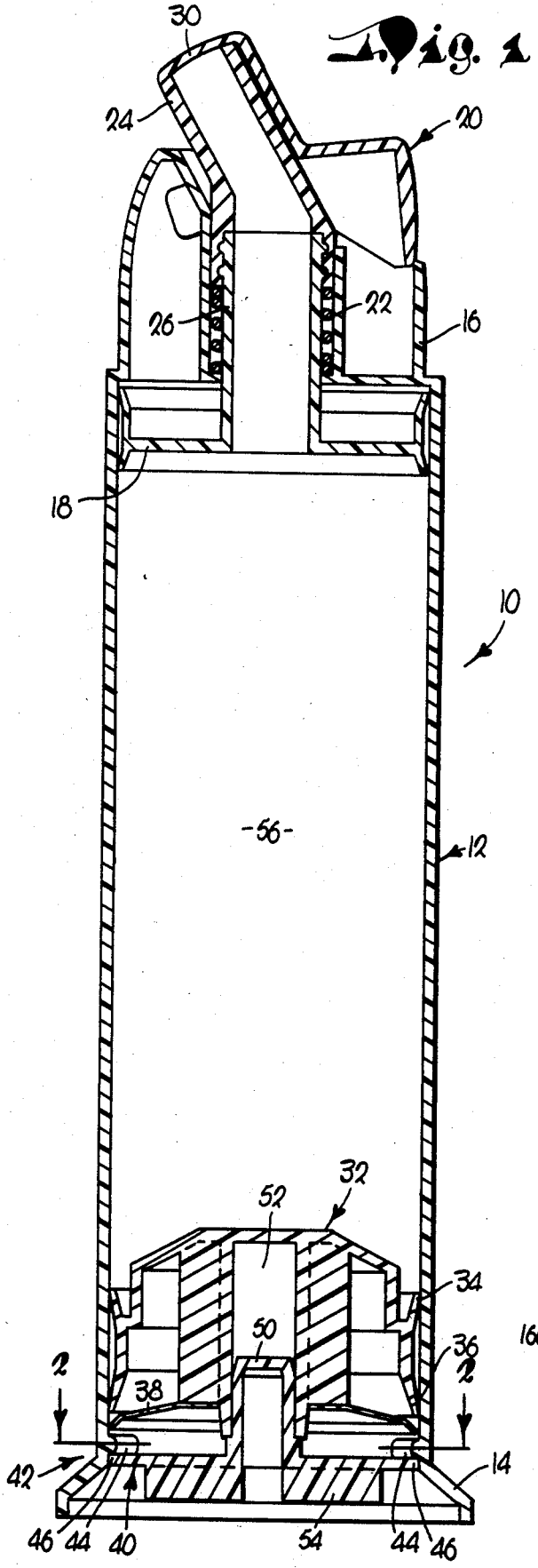
FIG. 1 is a vertical cross-sectional view of a viscous product dispenser utilizing one form of take-up piston locking means constructed in accordance with the principles of the present invention.

The dispenser 10 of FIG. 1 includes a tubular, cylindrical body 12 provided with a normally lower end 14 and a normally upper end 16. Adjacent the upper end 16, the body 12 is provided with a pumping piston 18 which may be reciprocated through an actuating lever 20 by depressing and releasing the latter. A coil spring 22 yieldably biases the piston 18 toward its unactuated position as illustrated in FIG. 1, and a discharge spout 24 is secured to the upper tubular shank 26 of piston 18 for guiding product out of a passage 28 defined by the internal configuration of the spout 24 and the shank 26 of piston 18. A valve flap 30 integral with and forming a part of the actuating lever 20 is operable to close off the outermost extremity of the spout 24 when the dispenser 10 is in a standby condition awaiting the next actuation.

A floating take-up piston 32 is housed within the body 12 adjacent the lower end 14 thereof and makes sealing engagement with the interior wall surface of the body 12 via a pair of upper and lower, outwardly flaring skirts 34 and 36. A downwardly and outwardly flaring resilient metal skirt 38 or the like also bears against the inner wall surface of the body 12 and is sufficiently resilient that it will deflect downwardly to any extent necessary to permit the piston 32 to rise in the body 12 yet at the same time is sufficiently stiff as to bite into the wall surface during attempted retrograde movement of the piston 32 downwardly within the body 12. A cover plate 40 of circular configuration is secured to the underside of the piston 32 in covering relationship to the metal skirt 38 so as to protectively shield the latter.

In accordance with the principles of the present invention, the dispenser 10 is provided with locking means broadly denoted by the numeral 42 for releasably retaining the take-up piston 32 against unintentional movement upwardly within the body 12. In the embodiment illustrated in FIGS. 1 and 2, such locking means 42 includes a pair of diametrically opposed and partially circumferentially extending, integrally formed shoulders 44 on the interior wall surface of the body 12 adjacent lower end 14, as well as cooperating peripheral edge portions 46 of the cover plate 40 which underlie the shoulders 44 when locking means 42 is locked and serve as abutments bearing against shoulders 44. The cover plate 40 is also provided with a pair of diametrically opposed, peripheral notch portions 48 corresponding in shape to the shoulders 44 and adapted to clear the latter when notches 48 are aligned with shoulders 44.

Figure 2:
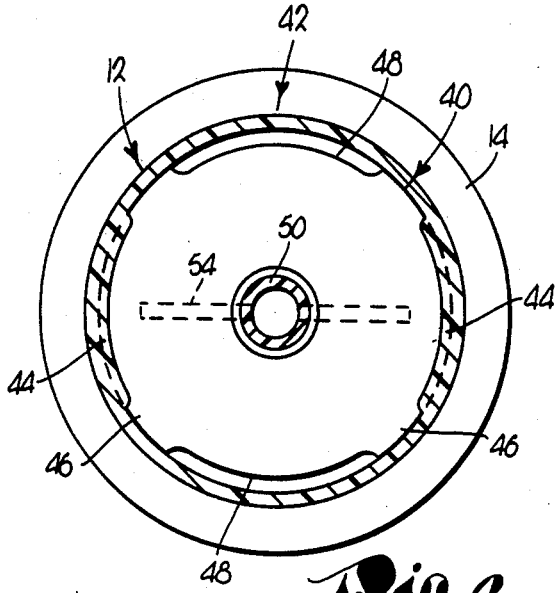
FIG. 2 is a transverse cross-sectional view thereof taken substantially along line 2—2 of FIG. 1.

The cover plate 40 is rotatable relative to the body 12 between a locking position in which the edge abutment portions 46 underlie the shoulders 44 (as shown in FIGS. 1 and 2) and a releasing position in which the notches 48 underlie and are aligned with the shoulders 44. In this respect, in its preferred form, the cover plate 40 is provided with an upwardly projecting stud 50 that is pressed securely into a receiving socket 52 in the piston 32 such that the cover plate 40 is not only securely attached to the piston 32 but is also normally prevented from rotation relative to the latter. Consequently, rotation of the cover plate 40 for releasing the locking means 42 also causes rotation of the piston 32, but such is of no consequence. A depending, finger-graspable blade 54 on the bottom of the cover plate 40 facilitates manual rotation of the latter.

When the dispenser 10 is first assembled and filled with product, the cover plate 40 is positioned as illustrated in FIGS. 1 and 2 such that the piston 32 is firmly locked in place. Any jarring or other vibrational impacts to the dispenser 10 during shipment and subsequent storage will have no effect upon the piston 32, and thus the product contained within the body 12 will have no particular tendency to attempt to exude from the spout 24. When it is desired to dispense product for the first time, the cover plate 40 is simply grasped by the blade 54 and rotated into such a position that the notches 48 are aligned with the shoulders 44. Thereupon, actuation of the lever 20 will cause the pumping piston 18 to be depressed, and because the metal skirt 38 prevents retrograde movement of the piston 32, such depression of the pumping piston 18 will cause product to be forced up and out of the passage 28. As is apparent, by actuating the lever 20, the valve flap 30 is likewise actuated to uncover the spout 24.

When the lever 20 is then released, the return spring 22 causes the pumping piston 18 to return to its normal raised position. Due to closing of the valve flap 30 and also due to the viscous nature of the product remaining within the passage 28, lifting of the piston 18 results in the creation of a negative pressure within the pumping chamber 56 between pistons 18 and 32. Inasmuch as the lower end of the take-up piston 32 is open to the atmosphere via the notches 48 in cover plate 40, as well as other clearances between the cover plate 40 and the interior wall surface of the body 12, the take-up piston 32 is caused to rise in the chamber 56 and ultimately decrease the volume thereof by an amount corresponding to the volume of the vacated product. The cover plate 40 travels along with the piston 32 during such take-up movement.

EMBODIMENT OF FIGS. 3 AND 4

Figure 3:
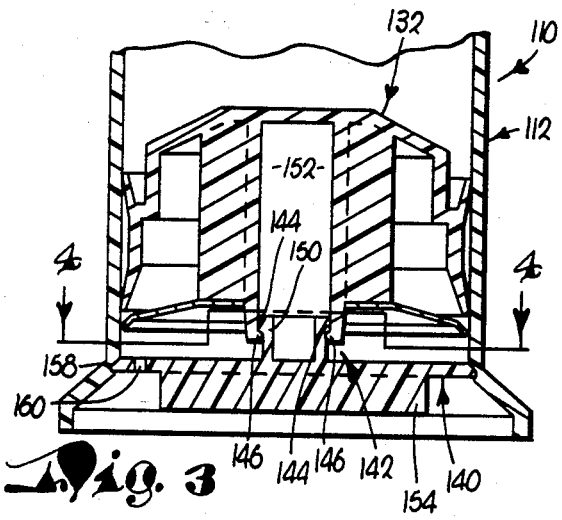
FIG. 3 is a fragmentary, vertical crosssectional view of the dispenser utilizing a second form of take-up piston locking means.
Figure 4:
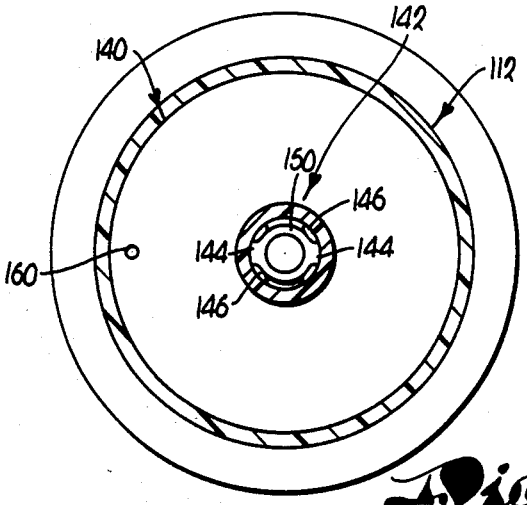
FIG. 4 is a transverse cross-sectional view thereof taken substantially along line 4—4 of FIG. 3.

The dispenser 110 of FIGS. 3 and 4 functions to dispense product in the same manner as the dispenser 10. So also do the dispensers of the remaining embodiments which will be subsequently described. In each case, it is the locking means for the take-up piston which varies, and therefore only details of the locking means for each embodiment will be hereinafter elaborated upon.

In the dispenser 110 and the stud 150 on cover plate 140 is rotatably received within socket 152 in piston 132, rather than being tightly pressed therein as in the first embodiment. The locking means 142 includes, as one of its interengageable parts, a pair of diametrically opposed shoulders 144 on the stud 150. Co-acting with the shoulders 144, and forming another part of the locking means 142, is a pair of diametrically opposed abutments 146 at the lower end of the socket 152. The abutments 146 project radially inwardly into the interior of the socket 152 and underlie the radially outwardly projecting shoulders 144 when locking means 142 is locked as illustrated in FIGS. 3 and 4, but when the cover plate 140 is rotated 90 degrees from the illlustrated position, shoulders 144 move into alignment with spaces between the abutments 146 whereby to clear the latter and permit upward travel of the piston 132.

The cover plate 140 has its outermost circular periphery snapped into a retaining groove 158 in the body 112 so that, while cover plate 140 may be rotated between its locking and unlocking positions utilizing the depending blade 154, the cover plate 140 cannot move axially of the body 112. Thus, once the piston 132 is released by appropriate positioning of the shoulders 144, the piston 132 rises in the body 112 without the cover plate 140 which remains behind in its retaining groove 158.

The cover plate 140 is provided with a small aperture 160 which exposes the bottom of the piston 132 to atmospheric pressure.

EMBODIMENT OF FIGS. 5 AND 6

The dispenser 210 is provided with locking means 242 which includes in part an opening or slot 262 in the sidewall of body 212, the upper extremity of the slot 262 serving as a limiting shoulder 244. An abutment 246 on the cover plate 240 is in the form of a radially projecting break tab which projects through the slot 262 and normally bears against the shoulder 244 when the locking means 242 is locked. A line of weakness **246*a* connects the abutment break tab 246 with the cover plate 240, and while such line of weakness 246*a* is sufficiently strong as to normally remain intact and prevent the piston 232 from rising in the body 212 during jostling and jarring, it is at the same time sufficiently weak and brittle as to permit severance of the tab 246 from the cover 240 when the tab 246 is manually worked up and down a few times to overstress the line of weakness 246*a***.

Once the tab 246 has been broken from the cover plate 240, the piston 232 and cover plate 240 are free to rise together in the body 212 under the influence of atmospheric pressure bearing against the cover plate 240.

EMBODIMENT OF FIGS. 7 AND 8

The dispenser 310 has locking means 342 wherein the shoulder 344 on the body 312 is in the nature of a downwardly projecting rim adjacent the lower end 314 of the body 312. The abutment 346 of the locking means 342 is in the nature of a tear strip which is integrally molded with the cover plate 340 at the outer circumferential edge thereof. The tear strip 346 overlaps the annular shoulder or rim 344 and complementally receives the latter, and there is a circumferential line of weakness **346*a* joining the tear strip 346 with the cover plate 340. Although the line of weakness 346*a* is adequately strong as to normally resist fracture and hold the piston 322 in place, by the same token it is sufficiently weak as to be torn from the cover 340 when a pull tab 346***b* of the strip 346 is gripped and pulled in a circumferential direction about the cover 340 so as to separate the strip 346 from the latter.

Once the strip 346 has been separated from the cover plate 340, the latter and the piston 332 are free to rise together in the body 312 under the influence of atmospheric pressure bearing against the underside of the plate 340. It will be noted that the strip 346 has a slight transverse cut 346*c* therein closely adjacent the pull tab 346*b* so as to facilitate the stripping separation of strip 346 from the cover plate 340.

EMBODIMENT OF FIG. 9

The dispenser 410 in FIG. 9 is provided with locking means 442 wherein the shoulder 444 comprises an annular step-like structure formed at the intersection of an enlarged diameter portion 412*a* of the body 412 and the normal diameter portion 412*b* of the body 412. The abutment 446 of the locking means 442 comprises the upper and outermost extremity of the upper outwardly flaring skirt 434 on the piston 432. As will be apparent, when initially installed the piston 432 is disposed within the enlarged diameter portion 412*a* of the body 412 with the upper skirt 446 bearing against the step shoulder 444. Preferably, the step shoulder 444 is beveled or inclined upwardly and inwardly in the nature of a ramp, rather than comprising an abrupt impediment or stop disposed in perpendicular relationship to the direction of axial travel of the piston 432. Consequently, while the step shoulder 444 provides adequate resistance to upward movement of the piston 432 as a result of jarring or jostling of the dispenser 412, such resistance is inadequate to retain the piston 432 in place when either a negative pressure condition exists within the body 412 after dispensing a quantity of product upon first actuation, or when the piston 432 is manually pushed upwardly a sufficient distance to cause the skirt 434 to override the step shoulder 444.

EMBODIMENT OF FIG. 10

The dispenser 510 in FIG. 10 has locking means 542 wherein the shoulder 544 is defined by the upper extrimity of an annular groove within the interior wall surface of the body 512 adjacent the lower end thereof. The abutment 546 of locking means 542 comprises the outermost end portion of the anti-retrograde metal skirt 538 associated with the piston 532. If desired, the groove 544 may rather closely confine the skirt 538 whereas to prevent all upward movement of the piston 532 except under the influence of strong forces such as occurring upon actuation of the dispenser 512 or manual pressure against the bottom of cover plate 530. Preferably, however, the groove 544 is sufficiently deep that the skirt 538 is not enabled to bottom out within the groove 544 and make biting contact therein. Furthermore, the groove 544 is preferably sufficiently wide as to thus receive the skirt 538 in what may be thought of as a free, unstressed state. Thus, in the event that the piston 532 should tend to be jostled upwardly, the skirt 538 remains within the confines of the groove 544 and the piston 532 is free to return to its initial position since the skirt 538 has not made biting, anti-retrograde engagement with the body 512.

It should be apparent that all of the foregoing embodiments of the locking means for the floating piston of the dispenser achieve the objective of preventing undue pressurization of the contents of the dispenser by the take-up piston in the event that rough handling is encountered. Yet, each of the disclosed embodiments may be easily released or overridden at the time of first actuation of the dispenser in order to prepare the take-up piston for performing its intended function.

We claim:

1. In a viscous product dispenser having a take-up piston at one end of a tubular body thereof which responds to the evacuation of product from the dispenser through an outlet by shifting of the piston in the body toward the opposite end thereof and decreasing the internal volume of the dispenser by an amount which corresponds to the volume of product discharged, the improvement comprising:

releasably interengageable locking means for preventing shifting of the take-up piston toward the opposite end of the body unless the locking means is released, said locking means including an abutment on the piston and a shoulder carried by the body disposed in blocking relationship to said abutment, said shoulder being selectively movable to a position clearing said abutment whereby to release the piston, said shoulder being rotatably mounted on said body for rotation relative thereto into said abutment-clearing position, said shoulder comprising a portion of a locking stud on a circular cover plate for said one end of the body, said cover plate being retained by holding means on said body against travel with the piston during said shifting thereof but being rotatable relative to the holding means of the body and the piston into said abutment-clearing position, said piston having a socket therein receiving said stud of the cover plate, said abutment being disposed within said socket.

* * * * *